United States Patent [19]

Hagen et al.

[11] 3,986,360

[45] Oct. 19, 1976

[54] EXPANSION TIDAL REGENERATOR HEAT ENGINE

[75] Inventors: Kenneth G. Hagen, Acton; Fred N. Huffman, Sudbury; Arthur E. Ruggles, Billerica, all of Mass.

[73] Assignee: Thermo Electron Corporation, Waltham, Mass.

[22] Filed: June 6, 1975

[21] Appl. No.: 584,316

[52] U.S. Cl. ..... 60/520; 60/526; 60/670; 417/379

[51] Int. Cl.[2] ..... F02G 1/04

[58] Field of Search ..... 60/516, 517, 520, 526, 60/531

[56] References Cited

UNITED STATES PATENTS

| | | | |
|---|---|---|---|
| 3,604,821 | 9/1971 | Martini | 60/526 X |
| 3,645,649 | 2/1972 | Beale | 60/517 X |
| 3,657,877 | 4/1972 | Huffman | 60/531 |
| 3,815,363 | 6/1974 | Huffman | 60/531 |

*Primary Examiner*—Allen M. Ostrager
*Attorney, Agent, or Firm*—James L. Neal

[57] ABSTRACT

An expansion mode tidal regenerator heat engine including a housing assembly enclosing an interior region, a power extraction means and a condensable vapor disposed within the interior region. A condenser is adapted to maintain a portion of the interior region at a condenser temperature equal to or below the boiling point of the working fluid at a predetermined minimum pressure. A super-heater is adapted to maintain a portion of the interior region at a super-heater temperature above the boiling point of the working fluid at a predetermined maximum temperature. A boiler is adapted to maintain a portion of the interior region below the super-heater temperature and above or equal to the boiling point of the working fluid at a predetermined maximum pressure. A tidal liquid regenerator is adapted to maintain a predetermined temperature gradient in the portion of the interior region between those characterized by the condenser and boiler temperatures and a vapor regenerator is adapted to maintain the predetermined temperature gradient in the portion of the interior region between those characterized by the boiler and super-heater temperatures. A cycle control means establishes a sequence of locations for the liquid vapor interface of the working fluid between and including the regions characterized by the boiler and condenser temperatures. The cycle control means successively establishes (1) heating and vaporizing of the working fluid at constant volume, vaporizing and super-heating the working fluid in part at constant pressure and in part with decreasing pressure (due to expansion), cooling at constant volume, condensing in part at constant volume and in part at constant pressure.

14 Claims, 12 Drawing Figures

END RETURN STROKE

BEGIN POWER STROKE

POWER STROKE
(BEGIN EXPANSION)

POWER STROKE
(MID-EXPANSION)

FIG. 3E
END POWER STROKE
(END EXPANSION)
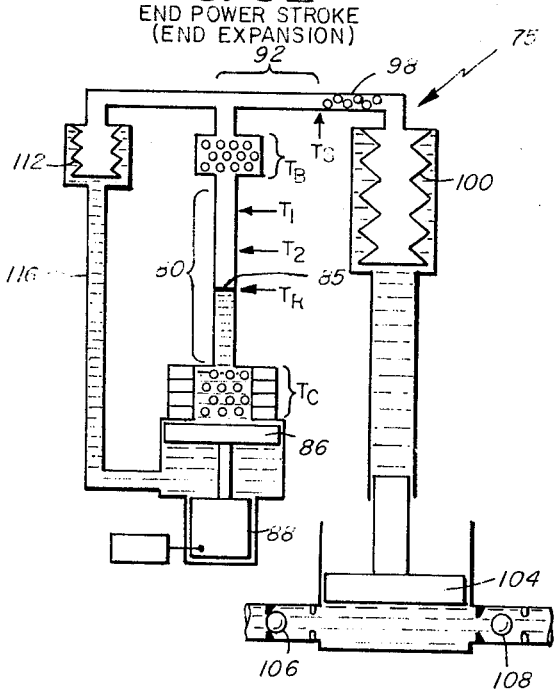
FIG. 3F
BEGIN RETURN STROKE
(PRESSURE RELEASE)
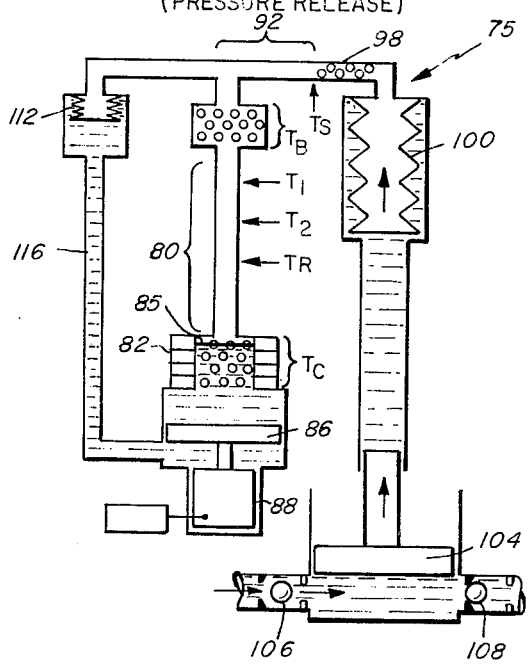
FIG. 3G
RETURN STROKE
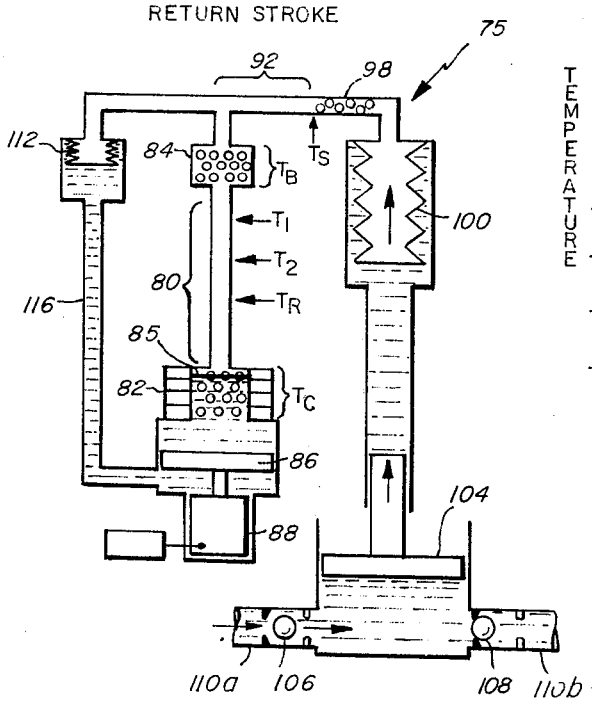
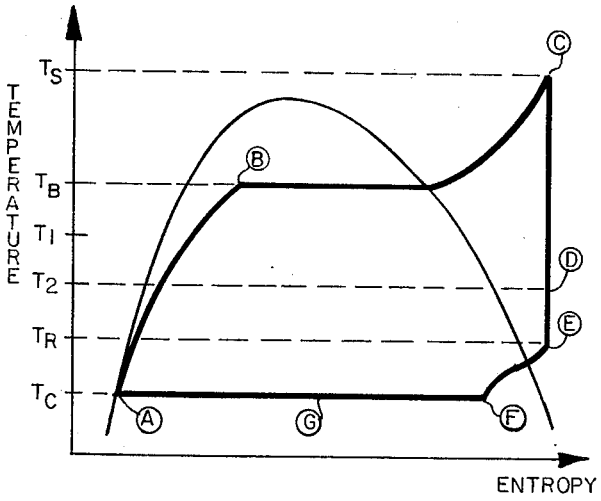
FIG. 4

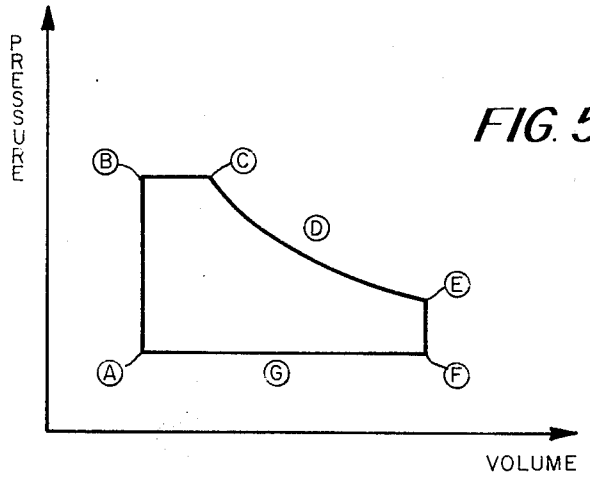
FIG. 5
FIG. 6
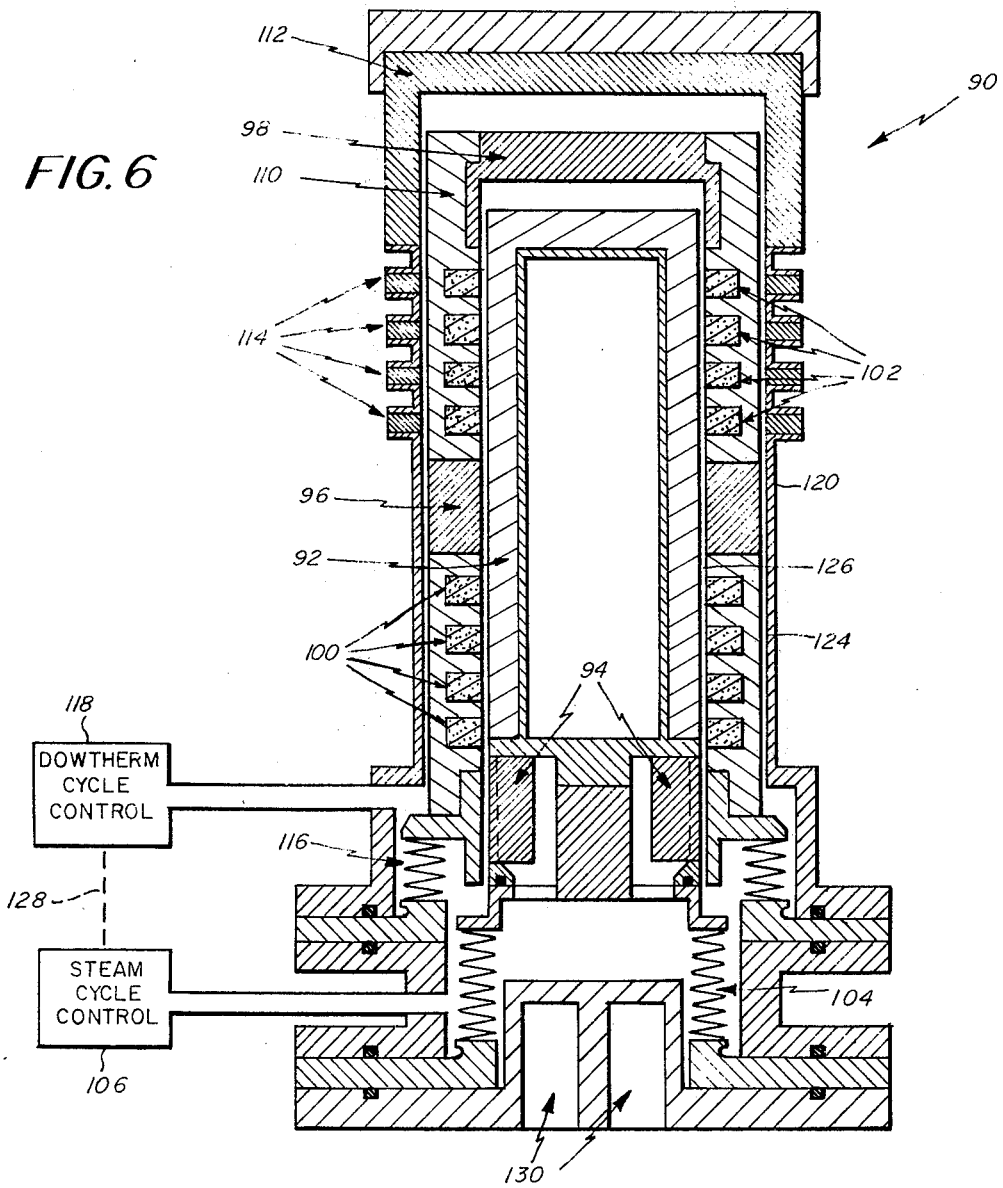

EXPANSION TIDAL REGENERATOR HEAT ENGINE

BACKGROUND OF THE INVENTION

This invention relates to vapor cycle heat engines and more particularly, to tidal regenerator heat engines.

Practical heat engines have been designed from derivatives of the basic Stirling cycle heat engine configuration, modified by substituting a condensable vapor for the gas as the working fluid. Such engines basically incorporate a tidal regenerator interconnecting two regions of differing temperature and a condensable vapor serving as a working fluid disposed therein. An associated displacement piston is arranged to selectively control the level of the working fluid in its liquid phase (i.e. the liquid-vapor interface) to pass between a relatively low temperature, condenser region at one end of the tidal regenerator (characterized by a condenser temperature less than the working fluid boiling point at a predetermined minimum vapor pressure) to a relatively high temperature, boiler region at the opposite end of the tidal regenerator (characterized by a boiler temperature equal to or greater than the working fluid boiling point at a predetermined maximum vapor pressure). As the level of the working fluid in its liquid phase is transferred between the two regions interconnected by the tidal regenerator, heat is regenatively stored or supplied by the tidal regenerator. In operation, the working fluid is sucessively heated and vaporized at constant volume, vaporized at constant pressure, super-heated at constant pressure, cooled at constant volume, condensed in part at constant volume and in part at constant pressure. Net work output is derived from a power piston, the piston being coupled by a bellows assembly which is actuated by the substantial difference (relative to a gas cycle engine such as the basic Stirling cycle engine) in the vapor pressure above the level of the working fluid between the states where the liquid level lies in the vaporizer region and in the condenser region. A single cycle (or working fluid) tidal regenerator engine of this type is disclosed in U.S. Pat. No. 3,657,877, assigned to the assignee of the present invention.

This basic tidal regenerator engine does provide substantial advantages over the previously developed heat engines, notably, absence of valves and sliding seals, incorporation of regeneration the enhance cycle efficiency, solid state electronic controls with characteristic flexibility, durability and low power consumption. However, the known power extraction techniques for use with the single cycle tidal regenerator engine place severe limits on peak cycle temperature due to the materials used. This temperature limitation results in a limitation in engine efficiency due to the relatively small difference between the means effective temperature at which heat may be added to the cycle and mean effective temperature at which heat is removed. This disadvantage of the single cycle tidal regenerator engine has been in part overcome in the prior art by the addition of a super-heater and vapor regenerator to the basic configuration. This disadvantage has been further overcome by the developments associated with multiple cycle tidal regenerator engines as disclosed in U.S. patent application Ser. No. 323,889, assigned to the assignee of the present invention. The multiple cycle tidal regenerator engines include at least two tidal regenerator engines similar to the single cycle type disclosed in U.S. Pat. No. 3,657,877, wherein a first engine operates at a relatively high temperature with a relatively low vapor pressure working fluid. This first engine provides either the entire or a substantial portion of the heat input of a second engine having a relatively high vapor pressure and operating at a relatively low temperature. Of course, successively lower vapor (or higher) pressure working fluid engines may be added in cascade. In each cycle component engine, condensation and evaporation of the working fluids take place in the same controlled manner as in the single cycle component engine. The working fluid levels in the component engines are synchronously controlled so that the output work from each component engine may be additively combined in phase.

In the case of a binary cycle engine, for example, a first working fluid having a relatively low vapor pressure is successively heated and vaporized at constant volume, vaporized at constant pressure, and condensed in part at constant volume and in part at constant pressure. The heat extracted during the condensation provides input heat to a second working fluid having a relatively high vapor pressure which is successively heated and vaporized at constant volume, vaporized at constant pressure, super-heated at constant pressure, cooled at constant volume, condensed in part at constant volume and in part at constant pressure. The heat required for the second low temperature working fluid cycle is provided from the heat rejected by the first high temperature working fluid cycle. The engines are synchronized in their operation so that the work extracted is additively combined by a power extraction means coupled to the relatively high temperature ends of each of the engines, that is, driven by the vapor pressure in the volume above the surface of the various working fluids. Generally, the power extraction means comprises a bellows associated with each engine with an isolation fluid, a power piston and an output bellows.

However, in both the prior art single cycle and multiple cycle tidal regenerator engines, there are many practical disadvantages which place limitations on the operating efficiencies of such engines. Notably, the power extraction means associated with each of the engines requires a bellows assembly. Such bellows assemblies typically include welded metal bellows. However, using such power extraction means, inefficiencies are introduced due in part to the void volumes in the folds of the bellows which must be effectively pressurized during the operational cycle. In addition, the use of bellows requires a high temperature interface fluid for transferring the power extracted from the hot end of the engine. The requirement for this interface fluid places a practical upper limit on the super-heat temperature of the engine to be approximately 650° Fahrenheit, using presently-known techniques in conjunction with commercially available organic materials as interface fluids. A further disadvantage of the systems associated with the power extraction means of the prior art is volume required for such bellows assemblies. This latter requirement is particularly important in view of present applications for such engines which are directed to a nuclear powered vapor cycle energy system for powering implantable artificial circulatory support systems.

Accordingly, it is an object of the present invention to provide an improved tidal regenerator engine configuration having increased efficiency with respect to prior art engines.

Another object is to provide an improved tidal regenerator engine having a configuration permitting a reduced size compared with prior art engines of similar displacement, power output and efficiencies.

SUMMARY OF THE INVENTION

In accordance with the present invention, an improved tidal regenerator engine is provided having an "annular" configuration wherein the power extraction means is coupled to the cold end of the tidal regenerator engine, i.e. near the condenser. As a result, this configuration eliminates the requirement for hot end bellows and isolation cylinder fluid while permitting a substantial increase in the peak cycle temperature with a corresponding increase in engine efficiency. A further result of this configuration is a reduction in system size compared with engines having similar displacement and power outputs.

A further aspect of the present invention includes the variation of the operation cycle to form an expansion configuration whereby an expansion portion of the operation cycle is provided with vaporization of the working fluid in part at constant pressure and in part with decreasing pressure. As a result of this aspect of the present invention, increased efficiency of operation may be attained with respect to the non-expansion or "standard" engine wherein the working fluid is vaporized substantially at constant pressure only.

In the expansion configuration, the operation cycle includes a step wherein as the pressure decreases during the expansion portion, the liquid-vapor interface is dropped through the regenerator. As a result, the vapor pressure equals the saturation pressure of the working fluid corresponding to the characteristic temperature of the regenerator at the point of the current liquid level.

Both aspects of the present invention, i.e. the improved physical configuration and the expansion during vaporization, provide increases in efficiency in both single cycle engines and in multiple cycle engines.

Furthermore, the aspects may be combined to provide a composite engine having an annular configuration and cold end power extraction means, together with the expansion configuration whereby a portion of the working fluid vaporization is achieved at constant pressure and a portion at decreasing pressure (and increasing volume).

Briefly, the configuration of the tidal regenerator engine directed to the first aspect of the invention includes a housing assembly enclosing an interior region having a cylindrical portion. A loosely fitting, relatively low thermal conductivity piston is disposed within the cylindrical portion. A condensable vapor serving as the working fluid is disposed within the interior region. The engine further comprises a boiler including means to establish a high temperature region within the housing assembly, near one end of the cylindrical portion, and a condenser including means to establish a low temperature region within the housing assembly near the other end of the cylindrical portion. A tidal liquid regenerator is employed between the boiler and condenser and includes at least one passive heat storage element and provides a predetermined temperature gradient in the shell region between those portions characterized by the boiler and condenser temperatures.

At the high temperature end in some embodiments, a super-hheater may also be employed including means to establish a temperature above the boiler temperature in a region within the housing assembly at the opposite end from the condenser. In super-heater embodiments, a vapor regenerator is disposed between the super-heater and the boiler. The vapor regenerator includes at least one passive heat storage element and provides a predetermined temperature gradient in the shell region between the portions characterized by the boiler temperature and super-heater temperature.

At all times in operation, the level of the working fluid is maintained in the annular cross-section, cylindrical shell region between the piston and interior walls of the cylindrical portion of the housing assembly.

A power extraction means is provided at the cold end of the engine, i.e. in the condenser region. In some embodiments, this extraction means includes a bellows assembly which is mechanically coupled to the cold end of the piston. The output end of the bellows assembly is connected to the housing assembly such that when the piston moves along a path substantially coaxial with the cylindrical portion of the housing assembly, the interior volume of the bellows is either expanded or compressed, depending on the direction of motion of the piston. A valve means may be used to couple out energy from the piston to an external hydraulic line via the bellows assembly.

A cycle control means is also provided whereby the level of the working fluid disposed within the interior region of the housing assembly is controlled successively to lie between and including the area characterized by the condenser temperature and the region characterized by the boiler temperature. As the level of the working fluid is passed through the various temperature regions, the presently described configuration functions in a substantially similar manner, in principal, to the tidal regenerator engine of the prior art. As the liquid level is displaced to the boiler, the region above the level of the working fluid is pressurized and expansion occurs which controls the cylinder to move in a motion away from the hot end toward the cold end. This motion may be coupled to an external load by way of a valve assembly.

It will be understood that for engines operating in the manner of the standard tidal regenerator engine (i.e. with no expansion occurring during the vaporization portion of the cycle), the configuration may work in alternative manners: in a first manner, the liquid level may be displaced to a point within the boiler for substantially the entire vaporization portion of the cycle by an external displacer piston for a configuration wherein the mean diameter of the power extraction bellows is substantially the same as the piston diameter. In this case, motion of the piston within the cylindrical portion of the housing assembly, and the coupled bellows, does not substantially affect the level of the working fluid in the cylindrical shell region. On the other hand, in other embodiments, where the latter limitation is not present, the displacer piston assembly may be configured to move in a manner to offset any tendency of the liquid to move from the boiler during this portion of the cycle due to piston motion.

In embodiments of the invention directed to the expansion configuration which provides expansion during the vaporization portion of the operational cycle (or power stroke), the displacement piston associated with either a prior art or annular tidal regenerator engine configuration may be adjusted to vary the level of the working fluid to portions of the cylindrical shell region wherein the temperature is less than the boiler temperature so that the pressure above the liquid level equals the saturation pressure associated with the temperature of the regenerator region associated with the current level of the liquid. In an annular expansion configuration, this may be also accomplished by use of an appropriate mean diameter bellows whereby the volume displaced by the bellows assembly varies with the position of the piston.

Of course, using the annular configuration alone, expansion configuration alone or a combined annular and expansion configuration in combination with the multiple cycle engine concept, yields corresponding improvements in efficiency as compared with the multiple cycle arrangement compared with the single cycle arrangement of the standard prior art tidal regenerator engine.

BRIEF DESCRIPTION OF THE DRAWINGS

The foregoing and other objects of this invention, the various features thereof, as well as the invention itself, may be more fully understood from the following description when read together with the accompanying drawings, in which:

FIGS. 3A–G show an exemplary expansion tidal regenerator engine in accordance with the present invention;

FIG. 4 shows the temperature-entropy characteristic of the engine of FIG. 3.

FIG. 5 shows the pressure-volume characteristic of the engine of FIG. 4; and

FIG. 6 shows an annular binary cycle tidal regenerator engine in accordance with the present invention.

DESCRIPTION OF THE PREFERRED EMBODIMENT

Figure 1:
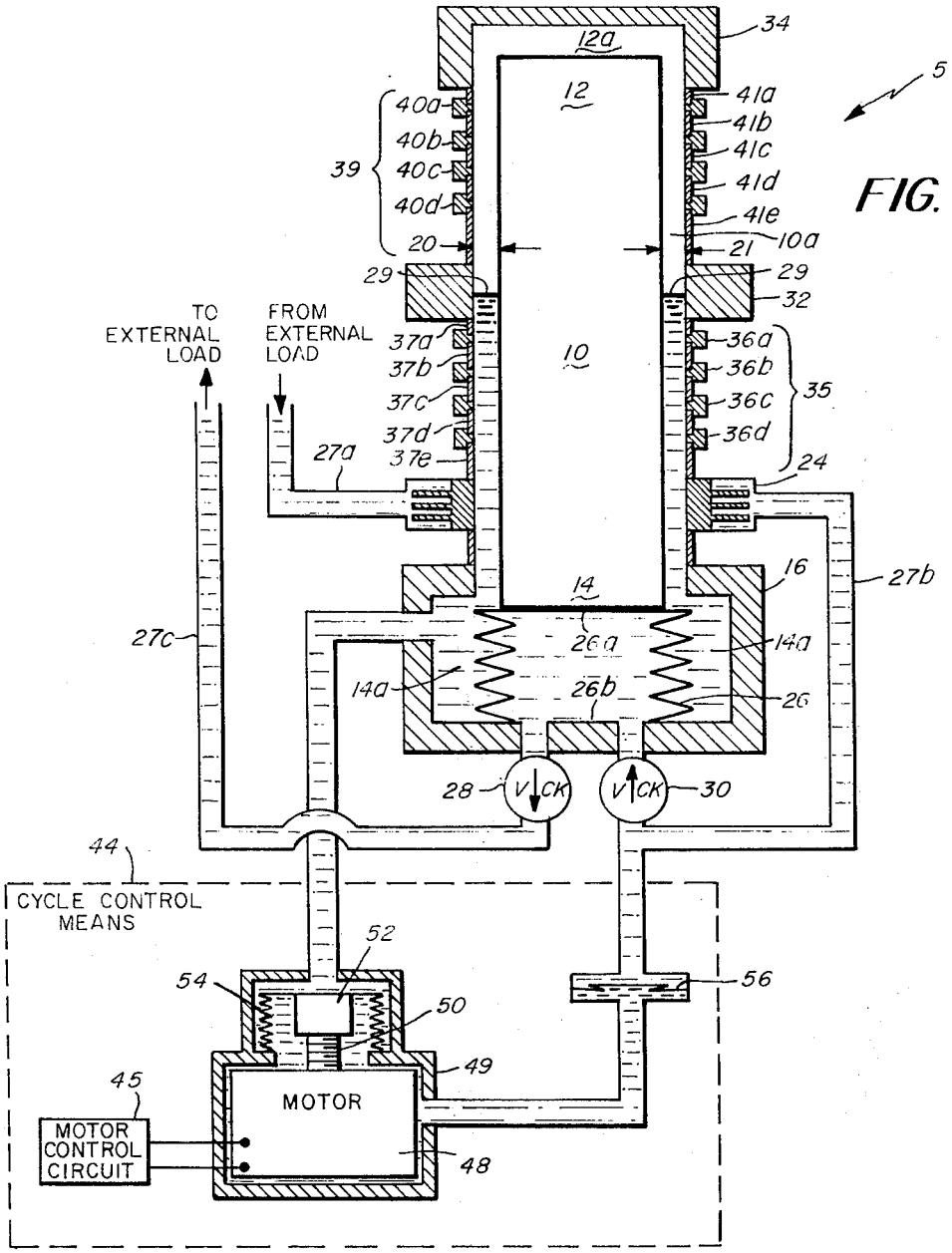
FIG. 1 shows an exemplary annular tidal regenerator in accordance with the present invention.

FIG. 1 shows in schematic cross-section form an annular tidal regenerator engine 5. The engine illustrated in FIG. 1 is a non-expansion configuration. Engine 5 includes a cylindrical piston 10 disposed within a housing assembly 16 and having a hot end 12 and a cold end 14. The piston 10 is preferably characterized by a relatively low thermal conductivity which may be achieved, for example, by a thin wall, hollow, stainless steel piston. In some embodiments, the interior of the piston may be evacuated to enhance the low thermal conductivity of the piston as a whole. The housing 16 encloses an interior region which includes a cylindrical portion having a diameter greater than that of the piston by a predetermined value and extending at least the length of the piston. The piston 10 is disposed within the housing in a manner establishing a first sub-region of the housing interior region **12*a* near the hot end 12, a second sub-region 14*a* near the cold end 14, and cylindrical shell sub-region 10*a* between the piston 10 and the interior surface of the cylindrical portion of housing 16**.

In the presently-described embodiment, the piston 10 is adapted for translational motion within the cylindrical portion, that translational motion being substantially coaxial with the cylindrical portion. The shell sub-region **10*a* in the present embodiment has a substantially annular cross-section. It will be understood that this configuration establishes an annular gap (denoted by reference numeral 20 and 21 in FIG. 1). The annular gap is maintained to be relatively small compared with the piston diameter, although the gap in FIG. 1 is exaggerated for clarity. By maintaining the gap relatively small, the piston 10 is constrained to translational motion substantially coaxial with the cylindrical portion of the housing 16**, although variations of this motion may exist in operation and as a result, the piston may on occasion interferingly engage the housing interior surfaces. In some embodiments, an additional means (comprising a pin and guide, for example) may be utilized to constrain the piston motion to be coaxial with the cylindrical portion.

A power extraction means including bellows 26 is also included in the interior region of the housing assembly 16. The input end **26*a* of the bellows is mechanically coupled to the piston 10 at its cold end 14**.

The interior region of the bellows 26 is coupled to an external load by way of check valves 28 and 30 at the output end **26*b* of the bellows and by a cooling jacket of a condenser 24 and hydraulic lines 27*a–c*. In this configuration, motion of the piston 10 in the downward direction, as illustrated, is effective to force hydraulic fluid from within the interior of bellows 26 through valve 28 and line 27*c* to an external load. As the piston 10 is moved in an upward direction, hydraulic fluid is drawn from the external load through line 27*a*, condenser 24*a* and valve 28 to the interior region of bellows 26**.

In other embodiments, different power extraction means may be utilized in keeping with the present invention. For example, the piston 10 may be mechanically connected to a means for driving a crankshift with a bellows included only to prevent leakage of the engine working fluid from the interior region of housing 16.

A condensable vapor is utilized as a working fluid in the engine of FIG. 1. It will be understood that the working fluid is disposed in the interior region of the housing 16 between the piston 10 and bellows 26 and the housing interior surfaces. A liquid-vapor interface 29 is maintained at all times at a point within the cylindrical shell region **10*a*, there being liquid in all portions of the interior region of the housing assembly below that of interface 23**, and there being vapor at all points above that interface.

In the present embodiment shown in FIG. 1, the mean diameter of the bellows 26 is exactly equal to the diameter of the piston 10 so that motion of the piston and resultant motion of the bellows assembly has substantially no effect on the level of the working fluid within the cylindrical shell sub-region.

The condenser 24 is positioned near the cold end 14 of the piston. The condenser 24 in the illustrated embodiment of FIG. 1 includes a cooling jacket permitting the flow therethrough of hydraulic fluid between lines **27*a* and 27*b*. In other embodiments as described more fully below, other forms of the condenser 24 may be utilized. The flow of hydraulic fluid in line 27*a–c*, in conjunction with the condenser 24, is arranged to maintain the adjacent portion of the cylindrical shell sub-region 10*a*** at a predetermined condenser temperature which is below the boiling temperature of the working fluid at a predetermined minimum vapor pressure.

A boiler 32 is shown adjacent to a portion of the cylindrical shell sub-region 102. It will be understood that the boiler 32 is arranged to maintain the adjacent portion of the cylindrical shell sub-region at a boiler temperature at least equal to the boiling point of the working fluid at a predetermined maximum vapor pressure. In this illustrated embodiment, the boiler 32 comprises a heat source and a copper ring with its innermost surface in contact with a portion of the outer boundary of shell sub-region 10*a*. In some embodiment, the innermost surface of the copper ring includes a copper screen which is diffusion bonded thereto to increase the effective boiler surface area.

A super-heater 34 is positioned near the hot end 12 of piston 10 and is arranged to maintain the adjacent portion of the cylindrical shell sub-region 10*a* at a super-heater temperature above that maintained by the boiler temperature.

A liquid regenerator 35 is disposed between the condenser 24 and the boiler 32. Regenerator 35 includes four passive heat storage elements 36*a–d* and five relatively low thermal conductivity elements interleaved to form a part of the interior surface of the cylindrical portion of housing 16. The regenerator 35 maintains a predetermined temperature gradient between the boiler temperature and the condenser temperature in the portion of shell region 10*a* adjacent thereto. In FIG. 1, the heat storage elements 36*a–d* are relatively thick copper rings interleaved with relatively thin stainless stell rings 37*a–e*.

Figure 2:
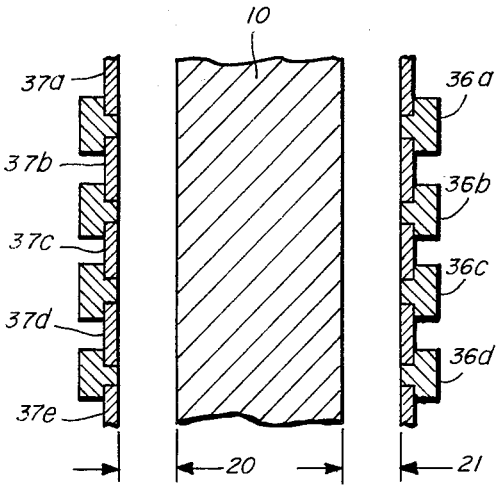
FIG. 2 shows the liquid regenerator of the engine of FIG. 1.

A cross-section of the liquid regenerator is shown in detailed form in FIG. 2. The heat storage elements 36*a–d* include faces in direct contact with the cylindrical shell region to permit a relatively high degree of thermal conduction away from the shell region. The stainless steel ring elements 37*a–e* provide a relatively poor thermal conductive path along the direction of the axis of the cylindrical portion of housing assembly 16. Using this configuration, the annular gap size is selected in conjunction with the characteristics of the working fluid so that as the interface 19 of the working fluid is arranged at any point within the liquid regenerator, a temperature may be maintained in shell region 10*a* which is characteristic of that particular point along the regenerator 35.

A vapor regenerator 39 is positioned near the cylindrical portion of the housing 16 between the boiler 32 and the super-heater 34. The vapor regenerator includes means for maintaining a predetermined temperature gradient between the boiler temperature and the super-heater temperature in the adjacent regions within the housing 16. In the embodiment of FIG. 1, the vapor regenerator is substantially the same as the liquid regenerator and includes four passive heat storage elements 40*a–d* interleaved by stainless steel rings 41*a–e*. The vapor regenerator operates in substantially the same manner as does the liquid regenerator 35.

A cycle control means 44 is shown to include a control circuit 45 coupled to a d.c. torque motor 48 disposed within displacer housing 49. The d.c. torque motor 48 is coupled to a displacer bellows 54 by way of ball screw 50 and a ball nut 52. The region exterior to bellows 54 within the displacer housing 49 is connected to the interior of housing assembly 16 at a point below the condenser 24. Since this region lies below interface 29, it is filled with working fluid in the liquid phase. In the embodiment of FIG. 1, the torque motor 48 and interior region of displacer bellows 54 is in contact with an isolation fluid which is maintained at an appropriate pressure by way of a fluid isolation diaphragm 56 in connection with line 27*b*.

In operation, the torque motor 48 is energized by the control circuit 45 to displace bellows 54 in a manner to appropriately control the level of the working fluid liquid-vapor interface 29 within the cylindrical shell region 10*a*. For example, in the standard or non-expansion tidal regenerator engine configuration, a cycle of operation is commenced by the full displacement initially of the bellows 54 so that the working fluid level 29 is displaced to the region of the cylindrical shell characterized by the boiler temperature (shown in FIG. 1). With the level at that temperature, the working fluid is vaporized at constant pressure and then superheated. During this portion of the operational cycle, the piston 10 is displaced in a downward direction as shown in response to the vaporization and super-heating of the working fluid, thereby establishing the power stroke. As a result, the bellows 26 is collapsed and energy is transferred from the engine to the external load via valve 28 and line 27*c*. During the next portion of the operational cycle, the torque motor 48 is controlled to collapse bellows 54 to its minimum position so that the level of the working fluid is lowered to the region of the cylindrical shell characterized by the condenser temperature. In consequence, the working fluid is condensed at constant volume until the temperature of the vapor reaches that characterized by the condenser and thereafter, condensed at constant pressure. In the latter portion of the cyle, the piston is displaced upward with the bellows expanding and drawing in fluid via line 27*a* and 27*b* from the external load.

The operation as so far described corresponds to that of the well-known tidal regenerator engine as described in U.S. Pat. No. 3,657,877 so far as the functional operation is concerned. However, it will be noted that the performance of all heat transfer operations with the working fluid occur within the cylindrical shell region 10*a* and result in motion of piston 10 within the cylindrical portion of housing 16. As a result, the energy imparted to the piston may be tapped at the cold end 14 of piston 10. Accordingly, the present invention eliminates the reliability and void volume problems associated with prior art engines due to the requirement for power extraction at the high temperature end of the engine using high temperature bellows. Furthermore, the isolation fluid is no longer required in this configuration, permitting operation at a higher temperature and lending simplicity to construction and also permitting a more compact engine for a given displacement. As a direct result, higher efficiencies may be achieved. Thus, the annular configuration of the present invention is well suited for applications where a compact tidal regenerator engine is desired in the standard (or non-expansion) mode. As described more fully below, the annular configuration is also readily adapted to expansion mode operation.

It will be understood that in other embodiments of the present invention, as with the prior art tidal regenerator engine, the super-heater 34 is not necessary for operation. This element is added to increase the efficiency by increasing the average temperature at which heat is added to the cycle.

Furthermore, in other embodiments, the condenser 24 may be cooled by the external hydraulic fluid, using a finned arrangement within the region adjacent to the bellows 26. In this configuration, compression and expansion of the bellows 26 is effective to drive a relatively large volume of the working fluid through the fins and transfer the cycle reject heat through the bellows to the output fluid. Such fins may alternatively be suitably heat sinked to the external environment, for example, to achieve air cooling.

An exemplary expansion tidal regenerator engine will now be described in conjunction with FIG. 3A–G. This configuration provides improved efficiency associated with expansion compared to the standard (i.e. non-expansion) configuration known in the prior art, while retaining specific advantages of constant pressure displacement engines (notably, pressure balanced, and valve free configuration). It will be noted that the engine 75 shown in FIGS. 3A–G is not arranged in the annular configuration, but has a configuration substantially similar to that shown in the prior art excepting for the cycle control means.

Figure 3A:
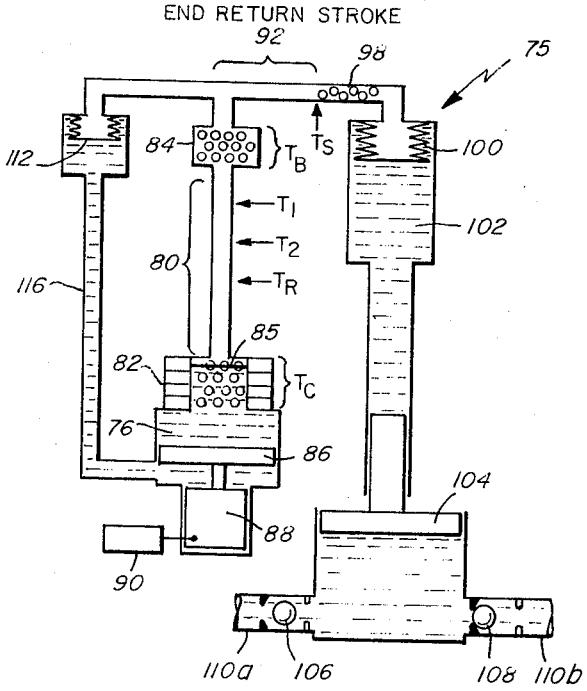

In the embodiment illustrated in FIG. 3A, a liquid regenerator 80 comprising a narrow column with heat storage elements enclosed within is shown interconnecting a condenser 82 and boiler 84. A condensable vapor working fluid 76 is disposed within the engine with a liquid-vapor interface 85 maintained in or between boiler 84 and condenser 82 at all times. A displacer piston 86 is controlled by a d.c. motor 88 which in turn is controlled by motor control circuit 90 so that piston 86 controls the nominal position of interface 85. The engine is configured so that the mass of working fluid in the liquid regenerator is small compared to the mass of working fluid vaporized in the boiler. This permits the engine to operate in a "starved" mode in which the vapor that can be supplied from the liquid regenerator is inadequate to maintain constant pressure as the piston 104 moves to bottom dead center. This occurs because as working fluid is vaporized at the liquid-vapor interface, the interface moves to progressively lower temperature points in the regenerator (with corresponding characteristic saturation pressures below the instantaneous pressure in the region above the interface).

The boiler 84 is connected to a first end of a vapor regenerator 92 including a plurality of passive heat storage elements. The vapor regenerator 92 is connected at its other end via a super-heater 98 to the power bellows assembly 100. Bellows assembly 100 is in turn coupled by way of an isolation fluid 102 to output piston 104, check valves 106 and 108, to output lines 110*a* and *b*. An equalizer bellows assembly 112 and pressure balance line 116 are included to balance the pressure of a load and the displacer piston 86.

It will be understood that the temperature associated with the points within the engine are indicated by the designations $T_s$ (super-heat temperature), $T_B$ (boiler temperature), $T_1$ (intermediate temperature within regenerator 80), $T_2$ (intermediate temperature within regenerator 80), $T_R$ (intermediate temperature within regenerator 80) and $T_C$ (condenser temperature).

FIGS. 3A–G illustrate the operational cycle for the expansion engine herein-described in conjunction with the Temperature-Entropy (T-S) diagram of FIG. 4. The encircled reference letters in FIG. 4 correspond to the points along the cycle illustrated by each of the correspondingly lettered ones of FIGS. 3A–G.

FIG. 3A shows the positions of the displacer piston 86 and power output piston 104 at the end of the return stroke. The displacer piston 86 is at the bottom of its stroke and the power piston 104 is at top dead center. The tidal level 85 is in the condenser 82 and the low system pressure corresponds to the saturation temperature of the condenser ($T_c$). These conditions correspond to state point (A) on the T-S diagram (FIG. 4).

Figure 3B:
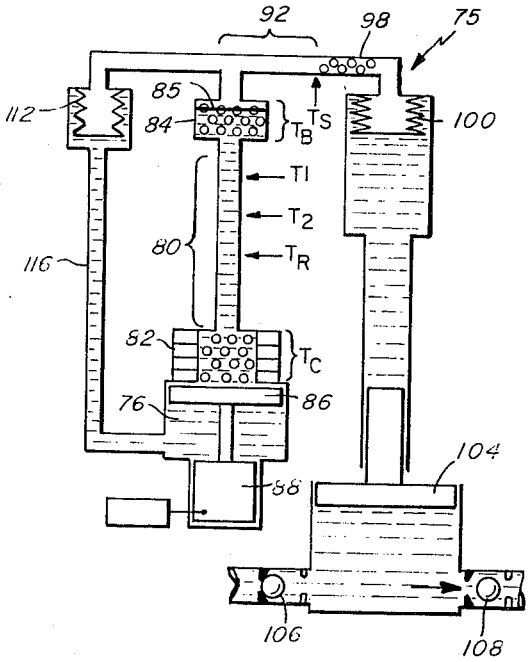

FIG. 3B illustrates the beginning of the power stroke initiated by the transition of the displacer piston 86 to the top of its stroke. The transition moves the tidal level 85 from the condenser 82 to the boiler 84. The system pressure throughout the engine is the saturation pressure corresponding to the temperature of the boiler ($T_B$). The conditions are represented by state point (B) on the T-S diagram (FIG. 4). During this portion of the cycle, the working fluid is vaporized to a relatively minor extent which is sufficient to pressurize the void volume to the peak pressure. The working fluid continues to be vaporized and is super-heated at constant pressure after reaching point B until the level 85 reaches the bottom of boiler 84. During this period, the output piston 104 is displaced downward at constant pressure.

Figure 3C:
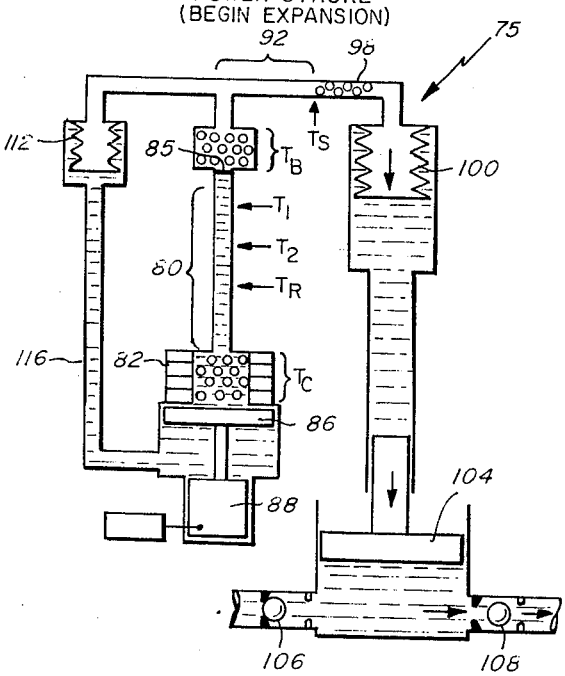

FIG. 3C shows the beginning of expansion. All of the liquid in the boiler has been vaporized and the working fluid level 85 is at the top of the liquid regenerator (i.e. bottom of the boiler) and is still at the boiler temperature, $T_B$. This condition is denoted as point (C) in FIG. 4. However, due to the relatively small mass of working fluid in regenerator 80 compared with that already vaporized in boiler 84, any further power piston motion downward tends to drop the engine pressure since the restricted quantity of working fluid in the liquid regenerator is insufficient to maintain pressure.

Figure 3D:
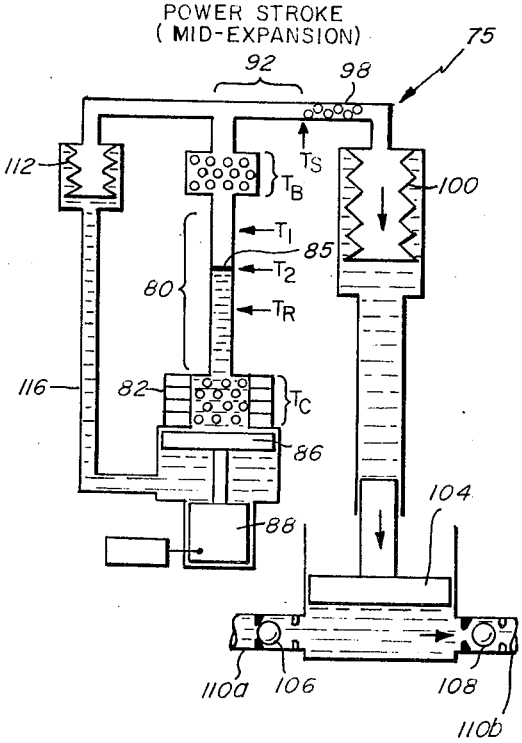

FIG. 3D shows the engine during mid-expansion and is denoted by (D) in FIG. 4. The engine has dropped to a saturation vapor pressure corresponding to temperature $T_2$. This drop in pressure "flashes" the working fluid in the liquid regenerator 80 down to a tidal level corresponding to the saturation temperature, $T_2$, which matches the engine pressure. This amount of fluid in the regenerator is very rapidly vaporized since it is already heated above saturation temperature. As noted above, the mass of working fluid liquid with temperatures initially between $T_B$ and $T_2$ is small compared to the mass required to charge the displaced volume to the peak pressure corresponding to the super-heater temperature, $T_s$.

The end of expansion (and of the power stroke) is illustrated in FIG. 3E. The engine pressure is now the release pressure. The corresponding tidal level in the liquid regenerator matches the release saturation temperature, $T_R$. The power piston 104 is at bottom dead center. The associated state point E is shown on the T-S diagram in FIG. 4.

Engine depressurization from the release pressure to the condenser pressure is shown in FIG. 3F wherein the displacer piston 86 is returned to its low position by motor 88 and the interface 85 is displaced to a point in the condenser 82. The power piston remains at bottom dead center. The liquid volume displaced as the displacer piston translates is accomodated by the compression of the equalizer bellows 112 so that constant volume cooling of the vapor occurs until reaching point (F) in FIG. 4. Between points (E) and (F), the engine pressure is greater than the saturation pressure associated with the condenser temperature, $T_c$.

The return stroke is depicted in FIG. 3G. The vapor in the cylinder is condensed at constant temperature $T_C$ and constant pressure. The return stroke is noted by state point G in FIG. 4.

An exemplary pressure-volume diagram is shown in FIG. 5 for the engine of FIGS. 3A–G with the encircled reference letters indicating the same portions of the operational cycle as the corresponding reference letters associated with FIGS. 3A–G and FIG. 4. As noted above, the portions between points Ⓑ and Ⓔ represent the power stroke.

The expansion tidal regenerator engine described above in conjunction with FIGS. 3A–G operates in a "starved" mode wherein the mass of working fluid in the liquid regenerator is small compared with the mass of working fluid vaporized in the boiler. As a result, with the displacement piston at its uppermost limit (i.e., maximizing the height of the liquid-vapor interface) the vapor that can be supplied from the liquid regenerator is inadequate to maintain constant pressure during the power stroke, and accordingly during a portion of the power stroke, the working fluid is vaporized with decreasing pressure.

In other embodiments, an expansion tidal regenerator engine may be configured without being in the starved mode and thereby eliminating the limitation on the relative masses of working fluid in the liquid regenerator and boiler. More particularly, in reference to the general configuration of FIG. 3A but wherein the mass of working fluid in the liquid regenerator 80 is not constrained to be small compared to that in boiler 84, the displacer piston 86 is controlled to be lowered to appropriate positions during the power stroke such that the liquid-vapor interface 85 is located at the identical succession of points within regenerator 80 as was the interface 85 in the starved mode configuration illustrated in FIGS. 3A–G. Thus, the displacer piston 86 controls the expansion during the power stroke. It will be understood, however, that this displacer controlled expansion tidal generator engine has an identical temperature-entropy characteristic (FIG. 4) as the starved mode configuration. In other embodiments, alternative means may be used to control the position of interface 85 during the operational cycle in order to achieve the expansion mode of operation.

The annular configuration of FIG. 1 may be used in still another alternative embodiment of the expansion tidal regenerator engine. In such an embodiment, the motor control circuit 45 may control displaces bellows 54 (via motor 48, ball screw 50 and ball nut 52) to vary the position of the liquid-vapor interface 29 during the power stroke. The interface 29 is controlled to remain in the portion of the annular cross section region 10*a* characterized by the boiler temperature for a first portion of the power stroke. The interface 29 is controlled to be lowered through the portions of region 10*a* adjacent to regenerator 35 during a second portion of the power stroke in a similar manner to that described above in conjunction with displacer controlled expansion engine of FIG. 3A.

As a result, the latter portion of the power stroke is carried out at decreasing pressure, thereby effecting the expansion mode of operation. The operational cycle of the engine 5 is otherwise unchanged.

The annular expansion tidal regenerator engine may also be embodied substantially as shown in FIG. 1 but wherein the average internal volume per unit length of the bellows 26 differs from that of the piston 10 in such a manner that, as the piston 10 moves downward during the power stroke, the interface 29 drops from the boiler portion of region 10*a* to the liquid regenerator portion of region 10*a* to provide decreasing pressure during the power stroke (i.e., the interface 29 is a function of piston position within housing 16). Of course, in this embodiment, the displacer piston may also aid in controlling the expansion portion of the cycle. In other embodiments, alternative means may be used to control the posiition of the interface 29 during the operational cycle to achieve the expansion mode of operation.

The annular configuration of the expansion tidal regenerator retains all of the advantages that the standard annular configuration has over the prior art tidal regenerator engines, e.g., increased efficiency, compactness, reliability, and cold end power extraction (elimination of high temperature bellows and isolation fluid) and combines these advantages with the increase in efficiency associated with the expansion mode of operation.

The multiple cycle configuration of the present invention provides similar advantages over their single cycle counterparts as the multiple cycle non-annular standard engine provided over its single cycle counterpart, while maintaining the advantages over the prior art associated with the annular configuration and expansion mode as noted above. These advantages include the increased efficiency due to the higher mean temperature at which heat is added and due to the heat regenerator associated with the cascaded component engines.

The annular tidal regenerator engine may be arranged in a cascaded multiple cycle configuration for operation in both the standard and expansion modes. FIG. 6 shows an exemplary annular binary cycle engine which may be operated in either the standard or expansion mode.

The annular binary cycle engine 90 of FIG. 6 includes a pair of concentrically arranged single cycle engines. The inner engine uses steam (relatively high vapor pressure) as a working fluid and the outer engine uses Dowtherm (relatively low vapor pressure) as a working fluid. The inner engine includes a fused quartz piston 92, a copper steam condenser 94, a copper steam boiler 96, steam super-heater 98, graphite steam liquid regenerator elements 100, graphite steam vapor regenerator elements 102, steam isolation bellows 104 and steam cycle control 106.

The outer engine includes a fused quartz piston 110, Dowtherm boiler 112, Dowtherm condenser 96 (Dowtherm condenser 96 also serves as steam boiler 96 by providing a heat transfer means between the two engines), copper Dowtherm regenerator elements 114, Dowtherm isolation bellows 116 and Dowtherm cycle control 118.

The piston 110 is arranged for reciprocal motion within the housing 120 of binary engine 90 while maintaining a substantially annular cross-section region 124 between piston 110 and housing 120. Piston 92 is arranged for reciprocal motion within piston 110 while maintaining a substantially annular cross-section region 126 between piston 92 and piston 110. The control 118 is effective to position the Dowtherm liquid-vapor interface within region 124, while control 106 is effective to position the steam liquid-vapor interface within the region 126. In operation, controls 106 and 118 operate synchronously (indicated by broken line 128 in FIG. 6) so that energy from the motion of pistons 92 and 110 may be additively coupled in phase via bellows 104 and 116 and check valves 130 to an external load.

For the standard (non-expansion) mode, controls 106 and 118 control the working fluid interfaces to synchronously move between their respective boiler and condenser so that the Dowtherm is successively heated and vaporized at constant volume, vaporized at constant pressure, and condensed in part at constant volume and in part at constant pressure. The steam is successively heated and vaporized at constant volume, vaporized at constant pressure, super-heated at constant pressure, cooled at constant volume, condensed in part at constant volume and in part at constant pressure. For this mode in the present embodiment, the bellows 104 and 116 have identical mean average diameters to the respective pistons 92 and 110.

For the expansion mode, controls 106 and 118 control the working fluid interfaces to synchronously move between their respective boilers and condensers so that the Dowtherm is successively heated and vaporized at constant volume, vaporized at constant pressure in part and at decreasing pressure (due to expansion) in part, cooled at constant volume, condensed in part at constant volume and in part at constant pressure. The steam is successively heated and vaporized at constant volume, vaporized and super-heated in part at constant pressure and in part at decreasing pressure (due to expansion), cooled at constant volume, condensed in part at constant volume and in part at constant pressure. For this mode, in the present embodiment, the level of the working fluid interface is controlled by the control means 106 and 118 and the bellows 104 and 116 have identical mean average diameters to the respective pistons 92 and 110. In other embodiments, one or both of the bellows may have a larger mean average diameter than its associated piston in order to establish the expansion.

The prior art cascaded multiple cycle configuration may also be operated in the expansion mode by either appropriately controlling the working fluid interface of at least one component engine to drop from the boiler through a portion of the liquid regenerator during the power stroke. This may be achieved either by the movement of the displacer piston, or inherently by the structure wherein the mass of working fluid in the regenerator is relatively small compared to the mass vaporized in the boiler.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. An expansion tidal regenerator heat engine comprising:

A. a housing assembly enclosing an interior region,

B. a power extraction means having an input and output end, said output being coupled to an external load, said external load providing a pressure to said output end, and said input end being coupled to said interior region, said extraction means including means for varying the volume of said interior region within predetermined upper and lower limit, in response to the pressure differential applied across said input and output ends, C. a condensable vapor serving as a working fluid and disposed in said interior region, D. a condenser positioned near a first end of said housing assembly and including means to maintain the adjacent region within said housing assembly at a condenser temperature, said condenser temperature being below the boiling point of said working fluid at a predetermined minimum vapor pressure, E. a super-heater positioned near the opposite end of said housing assembly from said condenser and including means to maintain the adjacent region within said housing assembly at a super-heater temperature, said super-heater temperature being greater than the boiling point of said working fluid at a predetermined maximum vapor pressure, F. a boiler positioned near a portion of said housing assembly between said condenser and said super-heater and including means to maintain the adjacent region within said housing assembly at a boiler temperature, said boiler temperature being equal to or greater than the boiling point of said working fluid at a predetermined maximum vapor pressure, and less than said super-heater temperature, G. a liquid regenerator positioned near said cylindrical portion between said condenser and said boiler, said liquid regenerator comprising at least one passive heat storage element and providing a predetermined temperature gradient between said condenser temperature and said boiler temperature in the adjacent region within said housing assembly, H. a vapor regenerator positioned near said cylindrical portion between said boiler and said super-heater, said vapor regenerator comprising at least one passive heat storage element and providing a predetermined temperature gradient between said boiler temperature and said super-heater temperature in the adjacent region within said housing assembly, I. a cycle control means for establishing a cyclical sequence of locations for the level of said working fluid in its liquid phase, said locations lying between and including the region characterized by said boiler temperature and the region characterized by said condenser temperature, said cycle control means including a synchronizing means to successively:

1. maintain the volume of said interior region above said fluid level substantially constant and establish said level in said region characterized by said boiler temperature during a first portion of a cycle, the duration of said first portion being equal to the time period required for the vapor pressure said level to substantially equal the saturation vapor pressure of said fluid associated with said boiler temperature, 2. maintain said level in said region characterized by said boiler temperature during a second portion of a cycle, the duration of said second portion being non-zero and less than the time required for said power extraction means to increase the volume of said interior region toward said upper limit in response to the pressure differential applied across said input and output ends, said vapor pressure above said level being substantially equal to the saturation vapor pressure of said fluid associated with said boiler temperature during said second portion, 3. decrease said level to a region characterized by a predetermined temperature between said boiler temperature and said condenser temperature during a third portion of said cycle, the duration of said third portion being non-zero and less than or equal to the time required for said power extraction means to increase the volume of said interior region to said upper limit in response to the pressure differential applied across said input and output ends, said vapor pressure being related at each point in time during said third portion to the current level of said fluid, said vapor pressure equalling the saturation vapor pressure of said fluid associated with the temperature characterizing said current region,
4. maintain the volume of said interior region above said level substantially constant and decrease said level to said region characterized by said condenser temperature during a fourth portion of said cycle, the duration of said fourth cycle being equal to the time period required for the vapor pressure above said level to equal the saturation vapor pressure of said fluid associated with said condenser temperature, and
5. maintain said level in said region characterized by said condenser temperature during a fifth portion of a cycle, the duration of said fifth portion of a cycle, the duration of said fifth portion being non-zero and less than or equal to the time required for said power extraction means to decrease the volume of said interior region to said lower limit in response to the vapor pressure differential applied across said input and output ends, said vapor pressure above said level being substantially equal to the saturation vapor pressure of said fluid associated with said condenser portion during said fifth portion.

2. The expansion tidal regenerator heat engine according to claim 1 wherein said cycle control means comprises:

1. a displacer piston and associated cylinder and housing assembly,
2. hydraulic coupling means for coupling the region adjacent to said displacer piston within said displacer piston within said displacer housing assembly to said region adjacent to said condenser, and
3. means for actuating said displacer piston to reciprocate in said displacer cylinder whereby the position of said liquid level is controlled in response to said reciprocal motion of said displacer piston.

3. The expansion tidal regenerator heat engine according to claim 1 wherein the volume of said interior region adjacent to said liquid regenerator is small relative to change in volume above said level during said second portion of said cycle.

4. An annular expansion tidal regenerator heat engine comprising:

A. a cylindrical piston having a hot and cold end and being characterized by a relatively low thermal conductivity,
B. a housing assembly enclosing said piston and an interior region having a substantially cylindrical portion with a diameter greater than the diameter of said piston, and further being adapted for translational motion of said piston within said cylindrical portion, said motion being substantially coaxial with said cylindrical portion, and wherein said piston is arranged within said interior region to provide a first sub-region adjacent to the hot end of said piston, a second sub-region adjacent to the cold end of said piston, and a cylindrical shell sub-region within said cylindrical portion and adjacent to the sidewalls of said piston, said shell sub-region having a substantially annular cross-section,
C. a power extraction means having input and output ends, said output end being coupled to an external load, said external load providing a load pressure to said output end, and said input end being coupled to the cold end of said piston, said extraction means including means for varying the volume of said sub-region adjacent to said hot end of said piston in response to the pressure differential applied across said input and output ends,
D. a condensable vapor serving as a working fluid and disposed in said sub-regions,
E. a super-heater positioned near said first sub-region, said super-heater including means to maintain the adjacent region within said housing assembly at a super-heater temperature, said super-heater temperature being above the boiling point for the said fluid at a predetermined maximum vapor pressure,
F. a condenser positioned near said second sub-region, said condenser including means to maintain the adjacent region within said housing assembly at a condenser temperature, said condenser temperature being below the boiling point of said working fluid at a predetermined minimum vapor pressure,
G. a boiler positioned near said cylindrical portion of said housing assembly between said super-heater and said condenser, said boiler including means to maintain the adjacent region within said housing assembly at a boiler temperature, said boiler temperature being less than said super-heater temperature and greater than or equal to the boiling point of said fluid at said predetermined maximum vapor pressure,
H. liquid regenerator positioned near said cylindrical portion between said condenser and said boiler, said liquid regenerator comprising at least one passive heat storage element and providing means for maintaining a predetermined temperature gradient between said condenser temperature and said boiling temperature in the adjacent region within said housing assembly,
I. vapor regenerator positioned near said cylindrical portion between said boiler and said super-heater, said vapor regenerator comprising at least one passive heat storage element and providing means for maintaining a predetermined temperature gradient between said boiler temperature and said super-heater temperature in the adjacent region within said housing assembly,
J. a cycle control means for establishing a cyclical sequence of locations for the level of said working fluid in its liquid phase, said locations lying between and including the region characterized by said boiler temperature and the region characterized by said condenser temperature, said cycle control means including a synchronizing means to successively:
   1. maintain the volume of said interior region above said fluid level substantially constant and establish said level in said region characterized by said boiler temperature during a first portion of a cycle, and duration of said first portion being equal to the time period required for the vapor pressure above said level to substantially equal the saturation vapor pressure of said fluid associated with said boiler temperature, 2. maintain said level in said region characterized by said boiler temperature during a second portion of a cycle, the duration of said second portion being non-zero and less than to the time required for said power extraction means to increase the volume of said interior region toward said upper limit in response to the pressure differential applied across said input and output ends, said vapor pressure above said level being substantially equal to the saturation vapor pressure of said fluid associated with said boiler temperature during said second portion,
3. decrease said level to a region characterized by a predetermined temperature between said boiler temperature and said condenser temperature during a third portion of said cycle, the duration of said third portion being non-zero and less than or equal to the time required for said power extraction means to increase the volume of said interior region to said upper limit in response to the pressure differential applied across said input and output ends, said vapor pressure being related at each point in time during said third portion to the current level of said first, said vapor pressure equalling the saturation vapor pressure of said fluid associated with the temperature characterizing said current region,
4. maintain the volume of said interior region above said level substantially constant and decrease said level to said region characterized by said condenser temperature during a fourth portion of said cycle, the duration of said fourth cycle being equal to the time period required for the vapor pressure above said level to equal the saturation vapor pressure of said fluid associated with said condenser temperature, and
5. maintain said level in said region characterized by said condenser temperature during a fifth portion of a cycle, the duration of said fifth portion being non-zero and less than or equal to the time required for said power extraction means to decrease the volume of said interior region to said lower limit in response to the vapor pressure differential applied across said input and output ends, said vapor pressure above said level being substantially equal to the saturation vapor pressure of said fluid associated with said condenser portion during said fifth portion.

5. The annular expansion tidal regenerator heat engine according to claim 4 wherein said cycle control means comprises:

1. a displacer piston and associated cylinder and housing assembly,
2. hydraulic coupling means for coupling the region adjacent to said displacer piston within said displacer piston within said displacer housing assembly to said region adjacent to said condenser, and
3. means for actuating said displacer piston to reciprocate in said displacer cylinder whereby the position of said liquid level is controlled in response to said reciprocal motion of said displacer piston.

6. The annular expansion tidal regenerator heat engine according to claim 4 wherein the volume of said interior region adjacent to said liquid regenerator is small relative to change in volume above said level during said second portion of said cycle.

7. The annular expansion tidal regenerator heat engine according to claim 4 wherein said power extraction means comprises a bellows assembly having an average internal volume per unit length greater than the volume per unit length displaced by said piston, whereby the level of said working fluid is dependent upon the position of said piston within said cylindrical portion such that said level decreases as said piston moves toward said condenser.

8. A cascaded multiple cycle heat engine comprising a plurality of single cycle tidal regenerator engines, each single cycle engine having a characteristic temperature range which is at least in part non-overlapping with the characteristic temperature range of said other single cycle engines, wherein said single cycle engines are arranged in descending thermal series with each of said single cycle engines being coupled by a heat transfer means with at least one adjacent engine in said series, and means responsive to changes in pressure communications with each of said single cycle engines for connecting said changes in phase to additive components of useful energy, wherein at least one of said single cycle engines is an expansion tidal regenerator engine comprising:

A. a housing assembly enclosing an interior region,
B. a power extraction means having an input and output end, said output end being coupled to an external load, said external load providing a pressure to said output end, and said input end being coupled to said interior region, said extraction means including means for varying the volume of said interior region within predetermined upper and lower limit, in response to the pressure differential applied across said input and output ends,
C. a condensable vapor serving as a working fluid and disposed in said interior region,
D. a condenser positioned near a first end of said housing assembly and including means to maintain the adjacent region within said housing assembly at a condenser temperature, said condenser temperature being below the boiling point of said working fluid at a predetermined minimum vapor pressure,
E. a super-heater positioned near the opposite end of said housing assembly from said condenser and including means to maintain the adjacent region within said housing assembly at a super-heater temperature, said super-heater temperature being greater than the boiling point of said working fluid at a predetermined maximum vapor pressure,
F. a boiler positioned near a portion of said housing assembly between said condenser and said super-heater and including means to maintain the adjacent region within said housing assembly at a boiler temperature, said boiler temmperature being equal to or greater than the boiling point of said working fluid at a predetermined maximum vapor pressure, and less than said super-heater temperature,
G. a liquid regenerator positioned near said cylindrical portion between said condenser and said boiler, said liquid regenerator comprising at least one passive heat storage element and providing a predetermined temperature gradient between said condenser temperature and said boiler temperature in the adjacent region within said housing assembly, H. a vapor regenerator positioned near said cylindrical portion between said boiler and said super-heater, said vapor regenerator comprising at least one passive heat storage element and providing a predetermined temperature gradient between said boiler temperature and said super-heater temperature in the adjacent region within said housing assembly, I. a cycle control means for establishing a cyclical sequence of locations for the level of said working fluid in its liquid phase, said locations lying between and including the region characterized by said boiler temperature and the region characterized by said condenser temperature, said cycle control means including a synchronizing means to successively:

1. maintain the volume of said interior region above said fluid level substantially constant and establish said level in said region characterized by said boiler temperature during a first portion of a cycle, the duration of said first portion being equal to the time period required for the vapor pressure above said level to substantially equal the saturation vapor pressure of said fluid associated with said boiler temperature,
2. maintain said level in said region characterized by said boiler temperature during a second portion of a cycle, the duration of said second portion being non-zero and less than to the time required for said power extraction means to increase the volume of said interior region toward said upper limit in response to the pressure differential applied across said input and output ends, said vapor pressure above said level being substantially equal to the saturation vapor pressure of said fluid associated with said boiler temperature during said second portion,
3. decrease said level to a region characterized by a predetermined temperature between said boiler temperature and said condenser temperature during a third portion of said cycle, the duration of said third portion being non-zero and less than or equal to the time required for said power extraction means to increase the volume of said interior region to said upper limit in response to the pressure differential applied across said input and output ends, said vapor pressure being related at each point in time during said third portion to the current level of said fluid, said vapor pressure equalling the saturation vapor pressure of said fluid associated with the temperature characterizing said current region,
4. maintain the volume of said interior region above said level substantially constant and decrease said level to said region characterized by said condenser temperature during a fourth portion of said cycle, the duration of said fourth cycle being equal to the time period required for the vapor pressure above said level to equal the saturation vapor pressure of said fluid associated with said condenser temperature, and
5. maintain said level lin said region characterized by said condenser temperature during a fifth portion of a cycle, the duration of said fifth portion being non-zero and less than or equal to the time required for said power extraction means to decrease the volume of said interior region to said lower limit in response to the vapor pressure differential applied across said input and output ends, said vapor pressure above said level being substantially equal to the saturation vapor pressure of said fluid associated with said condensor portion during said fifth portion.

9. The engine according to claim 8 wherein said cycle control means comprises:

1. a displacer piston and associated cylinder and housing assembly,
2. hydraulic coupling means for coupling the region adjacent to said displacer piston within said displacer piston within said displacer housing assembly to said region adjacent to said condenser, and
3. means for actuating said displacer piston to reciprocate in said displacer cylinder whereby the position of said liquid level is controlled in response to said reciprocal motion of said displacer piston.

10. The engine according to claim 8 wherein the volume of said interior region adjacent to said liquid regenerator is small relative to change in volume above said level during said second portion of said cycle.

11. A cascaded multiple cycle heat engine comprising a plurality of single cycle tidal regenerator engines, each single cycle engine having a characteristic temperature range which is at least in part non-overlapping with the characteristic temperature range of said other single cycle engines, wherein said single cycle engines are arranged in descending thermal series with each of said single cycle engines being coupled by a heat transfer means with at least one adjacent engine in said series, and means responsive to changes in pressure communicating with each of said single cycle engines for converting said changes in phase to additive components of useful energy, wherein at least one of said single cycle engines is an annular expansion tidal regenerator engine comprising:

A. a cylindrical piston having a hot and cold end and being characterized by a relatively low thermal conductivity, B. a housing assembly enclosing said piston and an interior region having a substantially cylindrical portion with a diameter greater than the diameter of said piston, and further being adapted for translational motion within said cylindrical portion, said motion being substantially coaxial with said cylindrical portion, and wherein said piston is arranged within said interior region to provide a first sub-region adjacent to the hot end of said piston, a second sub-region adjacent to the cold end of said piston, and a cylindrical shell sub-region within said cylindrical portion and adjacent to the sidewalls of said piston, said shell sub-region having a substantially annular cross-section, C. a power extraction means having input and output ends, said output end being coupled to an external load, said external load providing a load pressure to said output end, and said input end being coupled to the cold end of said piston, said extraction means including means for varying the volume of said sub-region adjacent to said hot end of said piston in response to the pressure differential applied across said input and output ends, D. a condensable vapor servicing as a working fluid and disposed in said sub-regions, E. a super-heater positioned near said first sub-region, said super-heater including means to maintain the adjacent region within said housing assembly at a super-heater temperature, said super-heater temperature being above the boiling point for said fluid at a predetermined maximum vapor pressure, F. a condenser positioned near said second sub-region said condenser including means to maintain the adjacent region within said housing assembly at a condenser temperature, said condenser temperature being below the boiling point of said working fluid at a predetermined minimum vapor pressure, G. a boiler positioned near said cylindrical portion of said housing assembly between said super-heater and said condenser, said boiler including means to maintain the adjacent region within said housing assembly at a boiler temperature, said boiler temperature being less than said super-heater temperature and greater than or equal to the boiling point of said fluid at said predetermined maximum vapor pressure, H. liquid regenerator positioned near said cylindrical portion between said condenser and said boiler, said liquid regenerator comprising at leaast one passive heat storage element and providing means for maintaining a predetermined temperature gradient between said condenser temperature and said boiling temperature in the adjacent region within said housing assembly, I. vapor regenerator positioned near said cylindrical portion between said boiler and said super-heater, said vapor regenerator comprising at least one passive heat storaae element an providing means for maintaining a predetermined temperature gradient between said boiler temperature and said super-heater temperature in the adjacent region within said housing assembly, J. a cycle control means for establishing a cyclical sequence of locations for the level of said working fluid in its liquid phase, said locations lying between and including the region characterized by said boiler temperature and the region characterized by said condenser temperature, said cycle control means including a synchronizing means to successively:

1. maintain the volume of said interior region above said fluid level substantially constant and establish said level in said region characterized by said boiler temperature during a first portion of a cycle, the duration of said first portion being equal to the time period required for the vapor pressure above said level to substantially equal the saturation vapor pressure of said fluid associated with said boiler temperature,
2. maintain said level in said region characterized by said boiler temperature during a second portion of a cycle, the duration of said second portion being non-zero and less than to the time required for said power extraction means to increase the volume of said interior region toward said upper limit in response to the pressure differential applied across said input and output ends, said vapor pressure above said level being substantially equal to the saturation vapor pressure of said fluid associated with said boiler temperature during said second portion,
3. decrease said level to a region characterized by a predetermined temperature between said boiler temperature and said condenser temperature during a third portion of said cycle, the duration of said third portion being non-zero and less than or equal to the time required for said power extraction means to increase the volume of said interior region to said upper limit in response to the pressure differential applied across said input and output ends, said vapor pressure being related at each point in time during said third portion to the current level of said fluid, said vapor pressure equalling the saturation vapor pressure of said fluid associated with the temperature characterizing said current region,
4. Maintain the volume of said interior region above said level substantially constant and decrease said level to said region characterized by said condenser temperature during a fourth portion of said cycle, the duration of said fourth cycle being equal to the time period required for the vapor pressure above said level to equal the saturation vapor pressure of said fluid associated with said condenser temperature, and
5. maintain said level in said region characterized by said condenser temperature during a fifth portion of a cycle, the duration of said fifth portion being non-zero and less than or equal to the time required for said power extraction means to decrease the volume of said interior region to said lower limit in response to the vapor pressure differential applied across said input and output ends, said vapor pressure above said level being substantially equal to the saturation vapor pressure of said fluid associated with said condenser portion during said fifth portion.

12. The engine according to claim 11 wherein said cycle control means comprises:

1. a displacer piston and associated cylinder and housing assembly,
2. hydraulic coupling means for coupling the region adjacent to said displacer piston within said displacer piston within said displacer housing assembly to said region adjacent to said condenser, and
3. means for actuating said displacer piston to reciprocate in said displacer cylinder whereby the position of said liquid level is controlled in response to said reciprocal motion of said displacer piston.

13. The engine according to claim 11 wherein the volume of said interior region adjacent to said liquid regenerator is small relative to change in volume above said level during said second portion of said cycle.

14. The engine according to claim 11 wherein said power extraction means comprises a bellows assembly having an average internal volume per unit length greater than the volume per unit length displaced by said piston, whereby the level of said working fluid is dependent upon the position of said pistin within said cylindrical portion such that said level decreases as said piston moves toward said condenser.

* * * * *